United States Patent [19]

Knickerbocker

[11] Patent Number: 5,043,202

[45] Date of Patent: Aug. 27, 1991

[54] CAMOUFLAGE SYSTEM AND MATERIAL USING THREE REFLECTIVE LEVELS

[75] Inventor: Harry W. Knickerbocker, Oregon City, Oreg.

[73] Assignee: Chameleon Camouflage System, Inc., Oregon City, Oreg.

[21] Appl. No.: 458,941

[22] Filed: Dec. 29, 1989

[51] Int. Cl.[5] ..... B32B 3/00

[52] U.S. Cl. ..... 428/195; 428/207; 428/919; D5/62; 427/258

[58] Field of Search ..... 428/195, 207, 919; D5/62; 427/258

[56] References Cited

U.S. PATENT DOCUMENTS

| | | | |
|---|---|---|---|
| D. 299,188 | 1/1989 | Norton | D5/62 |
| D. 301,289 | 9/1989 | McIlhinnez | D5/62 |
| D. 306,658 | 3/1990 | Haskell | D5/62 |
| D. 309,380 | 7/1990 | Barger et al. | D5/62 |
| 1,139,642 | 5/1915 | Cox | 428/919 X |
| 1,291,809 | 1/1919 | Ekker | 428/919 X |
| 1,817,871 | 8/1931 | Brundt | 428/919 X |
| 2,686,308 | 8/1954 | Courtois | 2/1 |
| 3,047,875 | 8/1962 | Patterson, Jr. | 2/1 |
| 3,690,671 | 9/1972 | Slutsky | 428/919 X |
| 3,967,026 | 6/1976 | Dalblom | 428/919 X |
| 4,375,488 | 3/1983 | Hogan | 428/17 |
| 4,576,904 | 3/1986 | Anitole | 430/347 |
| 4,656,065 | 4/1987 | Yacovella | 428/17 |
| 4,837,056 | 6/1989 | Easley | 428/919 X |
| 4,865,900 | 9/1989 | Shannon et al. | 428/919 X |
| 4,868,019 | 9/1989 | Knickerbocker | 428/17 |
| 4,876,817 | 10/1989 | Hill | 428/919 X |

*Primary Examiner*—Ellis P. Robinson
*Assistant Examiner*—William P. Watkins, III
*Attorney, Agent, or Firm*—Klarquist, Sparkman, Campbell, Leigh & Whinston

[57] ABSTRACT

The present invention discloses a camouflage system composed of a plurality of repetitious irregularly shaped background patterns having a first reflectance level. Spaces between the background patterns have a second reflectance level, greater than the first reflectance level. The spaces have unique widths such that groups of background patterns tend to blend together at intermediate distances but are still perceived as separate groups of patterns at larger distances. Foreground patterns having additional reflectance levels, less than the first reflectance level, overlay the background patterns and the spaces to make the background patterns and spaces indistinguishable at close distances.

3 Claims, 5 Drawing Sheets

CAMOUFLAGE SYSTEM AND MATERIAL USING THREE REFLECTIVE LEVELS

TECHNICAL FIELD

The present invention relates to a system and material to camouflage people or objects and, more specifically, to a system utilizing a plurality of repetitive patterns and spaces which can be applied to fabric and other material to render the object indistinguishable from the background.

COPYRIGHT MATERIAL

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

Camouflage systems and materials are well known in the art and have been used for centuries. Civilian uses for camouflage are primarily directed to concealing a hunter from wild game and other quarry. Military uses are primarily directed at concealing military personnel and equipment from enemy forces.

The primary camouflage systems used in the past have attempted to duplicate the background and surroundings by using patterns meant to mimic trees, tree bark, leaves, grass and other natural material and objects.

This approach has only been partially successful. One problem has been the inability to develop a camouflage system which is applicable to a multitude of background surroundings. The second problem has been the inability to develop a camouflage system which is not perceivable at various distances. A camouflage system which copies tree leaves, for instance, may render the wearer indistinguishable at close distances but: as the wearer retreats further from the quarry the pattern tends to become a single bold pattern which would stand out against the background.

A need therefore exists for a camouflage system which is effective as a camouflage at differing recognition distances.

SUMMARY OF THE INVENTION

The present invention is an improved camouflage system for visually concealing people and objects from animals or other people. Since some animals are color blind, the system is based in part on the neutral value scale, in which a color is evaluated based on its reflectance level, rather than strictly on its hue.

A plurality of repetitive background patterns having irregularly shaped borders are separated by relatively narrow spaces. Each of the spaces has an unique but not necessarily constant width. The size of the background patterns and the selection of the widths of the spaces between the background patterns are chosen such that the individual background patterns are only distinguishable at close range. As the camouflaged person or object is moved a greater distance from the observer the narrow spaces between the background patterns tend to blend into the background pattern thus increasing the perceived size of the background pattern. At least a portion of the width of some of the spaces is chosen to be large enough such that even at large distances a group of the background patterns are still perceived as being separated by the spaces. This is accomplished by the background patterns having a first reflectance level and the spaces having a second reflectance level greater than the first reflectance level.

A plurality of repetitive foreground patterns overlays the background patterns and the spaces to further disguise any distinguishable pattern. The foreground patterns are a plurality of shapes, each of the shapes being smaller than the smallest background pattern. The shapes have additional reflectance levels less than the reflectance level of the background patterns. In a preferred embodiment the average of the first reflectance level, the second reflectance level and the additional reflectance levels is chosen to equal the average reflectance level of the surroundings in which the camouflage system is to be used.

It is an object of the invention to provide a camouflage system which can be applied to fabric and other objects in a repetitive sequence to render the fabric or object indistinguishable at various distances.

It is a further object of the invention to provide a camouflage system which may be easily applied to fabric or other objects by conventional printing, painting or applique techniques.

It is also an object of the invention to provide a camouflage system which does not loose the camouflage effect as the wearer or user approaches the quarry.

Other objects and advantages of the present invention will be apparent from the following descriptions of a preferred embodiment thereof and from the attached drawings.

DETAILED DESCRIPTION

It has been found that certain camouflage systems are distinguishable against the background not merely because of their color differences but because the patterns can be easily discernable against the background. This is rather true of bold patterns which are highly discernable at close ranges because the spaces between the bold patterns become visible and are also clearly distinguished against the surroundings at large distances because the spaces between the patterns are totally indistinguishable. This pattern recognition is true even though the colors have been chosen to mimic the background colors of the surroundings. Since some animals are color blind, the current system is based in part on the neutral value scale in which a color is evaluated based upon its reflectivity rather than its associated hue.

Figure 1:
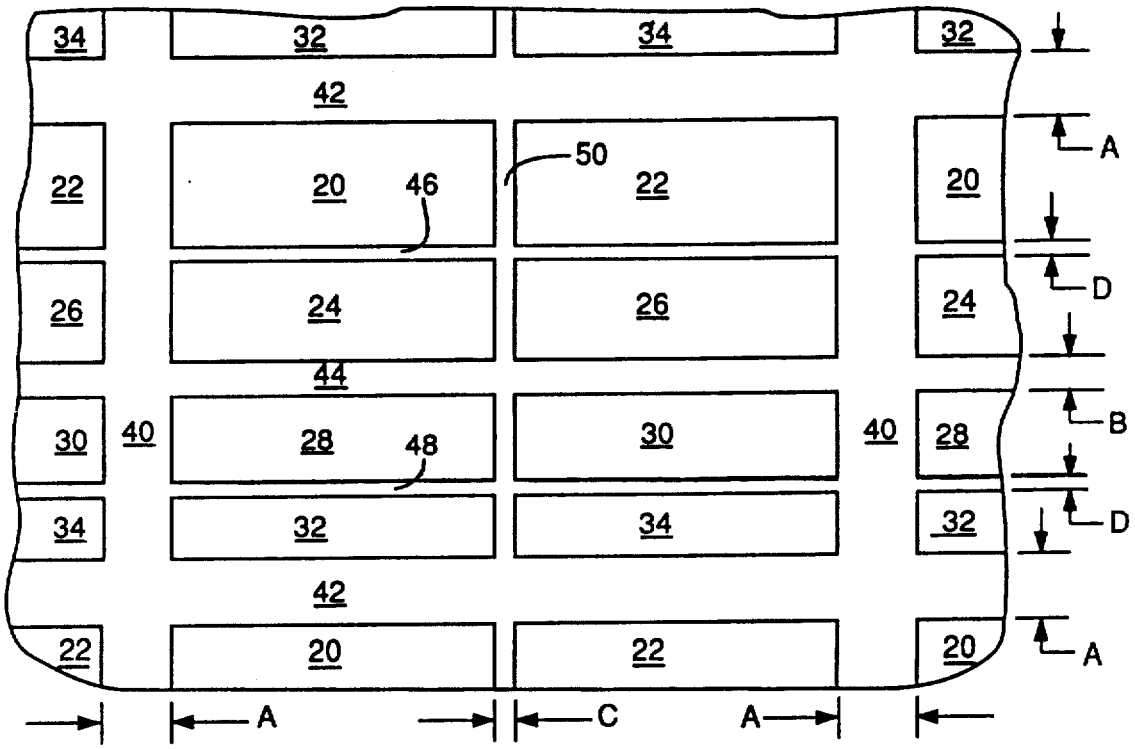
FIG. 1 shows generalized background patterns and spaces between the background patterns cf the camouflage system of the present invention.

Referring now to FIG. 1, a plurality of background patterns 20–34 are broken up by a plurality of spaces 40–50. The background patterns 20–34 have a first reflectivity level, as will be explained below, and the spaces 40–50 have a second reflectivity level which is greater than the first reflectivity level, as will be explained below. The plurality of rectangular patterns shown in FIG. 1 are for illustrative purposes only. In the present invention, none of the background patterns will have horizontal and vertical borders as is indicated in FIG. 1. Rather, each border will have an irregular shape and will be bounded by spaces. In the example of FIG. 1, background pattern 20 is bounded on the one side by a vertical running space 40 which has a width dimension of A. For purposes of this explanation width dimension A is 1". On the upper edge, background pattern 20 is bordered by a horizontal space 42, again having a dimension A of 1". The right border is a vertical space 50 having a width dimension of C which is approximately ¼". Space 42 on the lower edge of background patterns 32 and 34 is another horizontal space 42 having a width dimension of A of approximately 1". Space 44 is a horizontal space between background patterns 24 and 28 and background patterns 26 and 30 having a width dimension of B which for the purposes of this example is ½". Spaces 46 and 48 are both horizontal spaces having a width dimension of D which for purposes of this explanation is approximately ⅛". It will be appreciated from these numbers that the ratio of the widths of spaces B to C to D is 4:2:1.

At close range of approximately 25 yards, each of the individual background patterns 20–34 will be perceived as individual patterns. As the observer moves further from the camouflaged person or object, groups of background patterns will tend to merge because the spaces between the patterns will become indistinguishable. For instance, at approximately 50 yards, the horizontal spaces 46 and 48 will become indistinguishable. Background pattern 20 will tend to merge with background pattern 24 to form a single pattern of a group of patterns. Similarly, background pattern 22 will tend to merge with background pattern 26 creating a single visual background pattern. In a similar manner, background pattern 28 will tend to merge with background 32 and background pattern 30 will tend to merge with 34. Therefore, at a distance of approximately 50 yards, only four background patterns will be distinguishable, namely the combination of 20 and 24, the combination of 22 and 26, the combination of 28 and 32, and the combination of 30 and 34 as explained above.

At 75 yards, the vertical space 50 will tend to become indistinguishable. Therefore, at 75 yards, only 2 patterns will be distinguishable. The first pattern will be a group of background patterns 20, 22, 24, and 26. The second distinguishable background pattern will be a combination of background patterns 28, 30, 32, and 34.

As the observer further retreats from the camouflaged person or object, space 44 will become indistinguishable at approximately 100 yards. At 100 yards, a single perceivable pattern comprised of background patterns 20, 22, 24, 26, 28, 30, 32, and 34 will be distinguishable. The pattern will still be separated by the spaces 40 and 42. Not until the observer retreats to greater than 175 yards, will the 1" wide patterns tend to become indistinguishable.

In a preferred embodiment of the invention, none of the borders of any of the background patterns will be straight horizontal or vertical lines. Consequently, none of the spaces between the patterns will be defined by horizontal or vertical lines. In addition, the spaces for purposes of perception, need not completely cross groups of patterns nor in a preferred embodiment are they a constant width.

Figure 2:
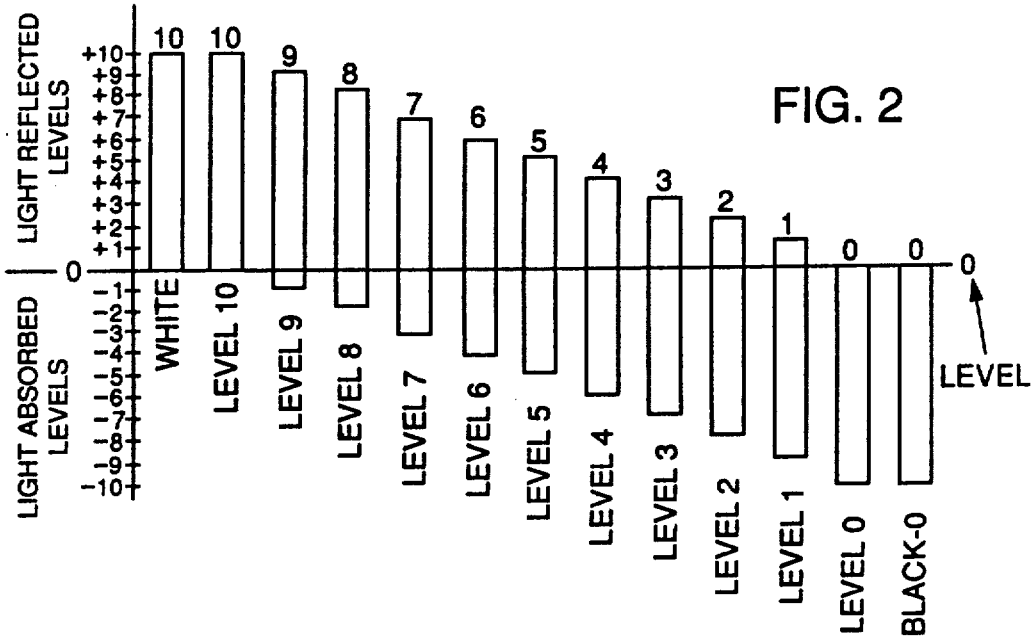
FIG. 2 shows levels of reflectance on a graduated scale for the various components of the camouflage system of the present invention.

Referring now to FIG. 2, a neutral value scale, based upon reflected light, is shown. The neutral colors are white, gray, and black which lack hue and differ from one another only in brightness or the degree of lightness and darkness. Brightness is measured by determining the reflectance of a surface. The reflectance is affected not only by absorption by the surface but also by the intensity of the illuminating light. A surface that is said to be white if it reflects about 80 percent of the visible light of any wave length that falls on it and black if it reflects only about 5 percent. Various shades of gray are between those extremes.

FIG. 2 illustrates the various levels of light absorption and reflection for hues of gray ranging on a neutral value scale from 0, highest absorption, to 10, highest reflectance. It should be noted that although this reflectance scale is based upon neutral colors of white, gray, and black, that various colors and hues may also be applied in the same principal. For instance, light colors, such as yellow, would have a reflectance level of 9, and dark colors, such as navy blue, would have a reflectance level of 2.

The camouflage may be applied as a first color carrier such as pigmented paint, cosmetics, or dye on fabric for a first reflectance level. A second color carrier such as paint, cosmetics, or dye on fabric can fill in the gaps or spaces between the background patterns for a second reflectance level and foreground patterns may be applied by additional color carriers.

Alternate methods may also be employed to change the reflectance level having only black and white. For instance, half-tone printing may be used: to vary the reflectance level of a given background. This is caused by placing a series of dots of a black color reflectance level 0 against a white background of a reflectance level of 10. The closer the dots and the more area of the background pattern covered, the lower the reflectance level. Fewer or smaller dots can cause more of the background area having a reflectance level of 10 to show, thus, giving an average reflectance level greater on the reflectance scale.

Figure 3:
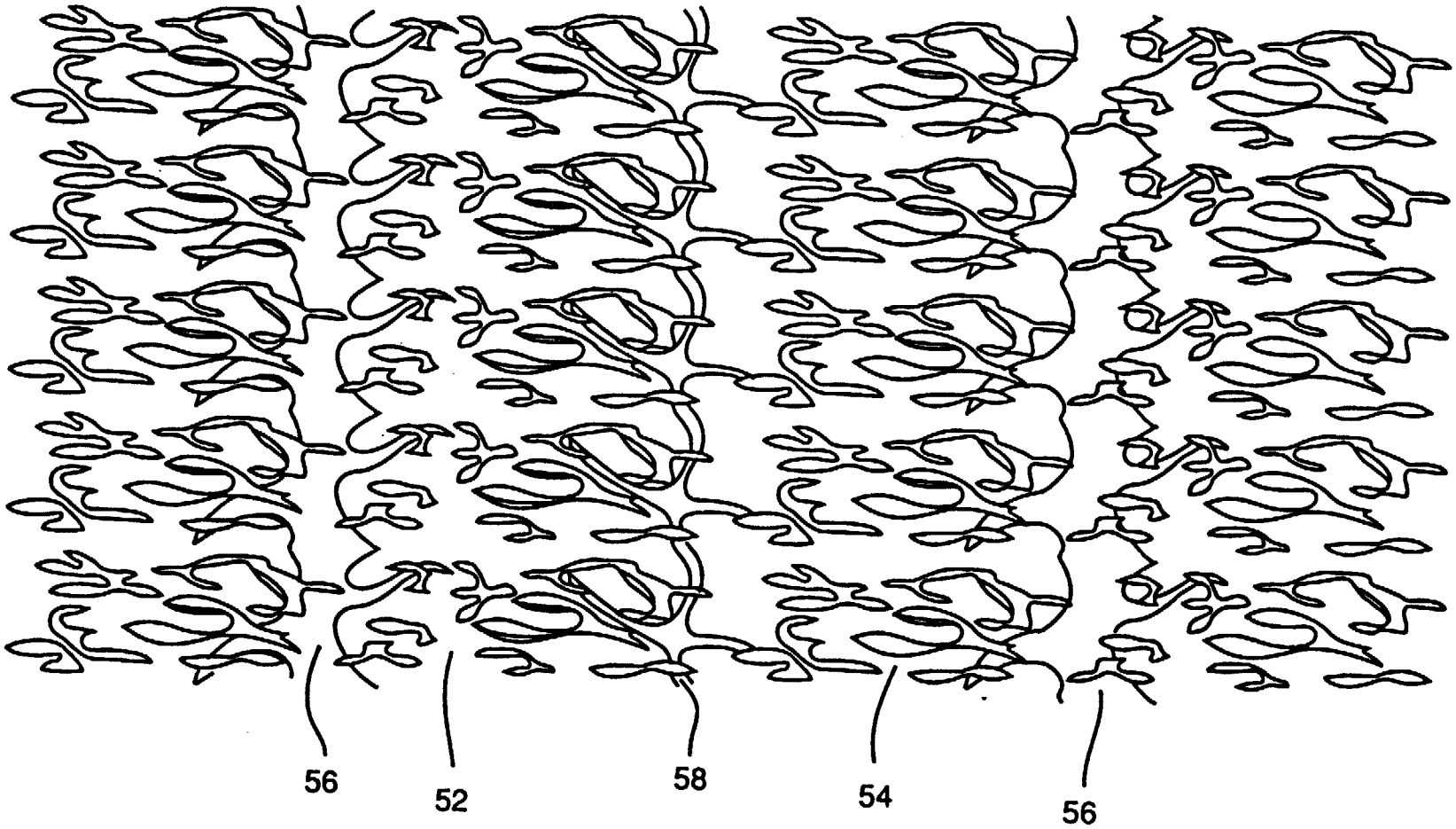
FIG. 3 Shows a specific embodiment of a camouflage system according to the present invention.
Figure 4:
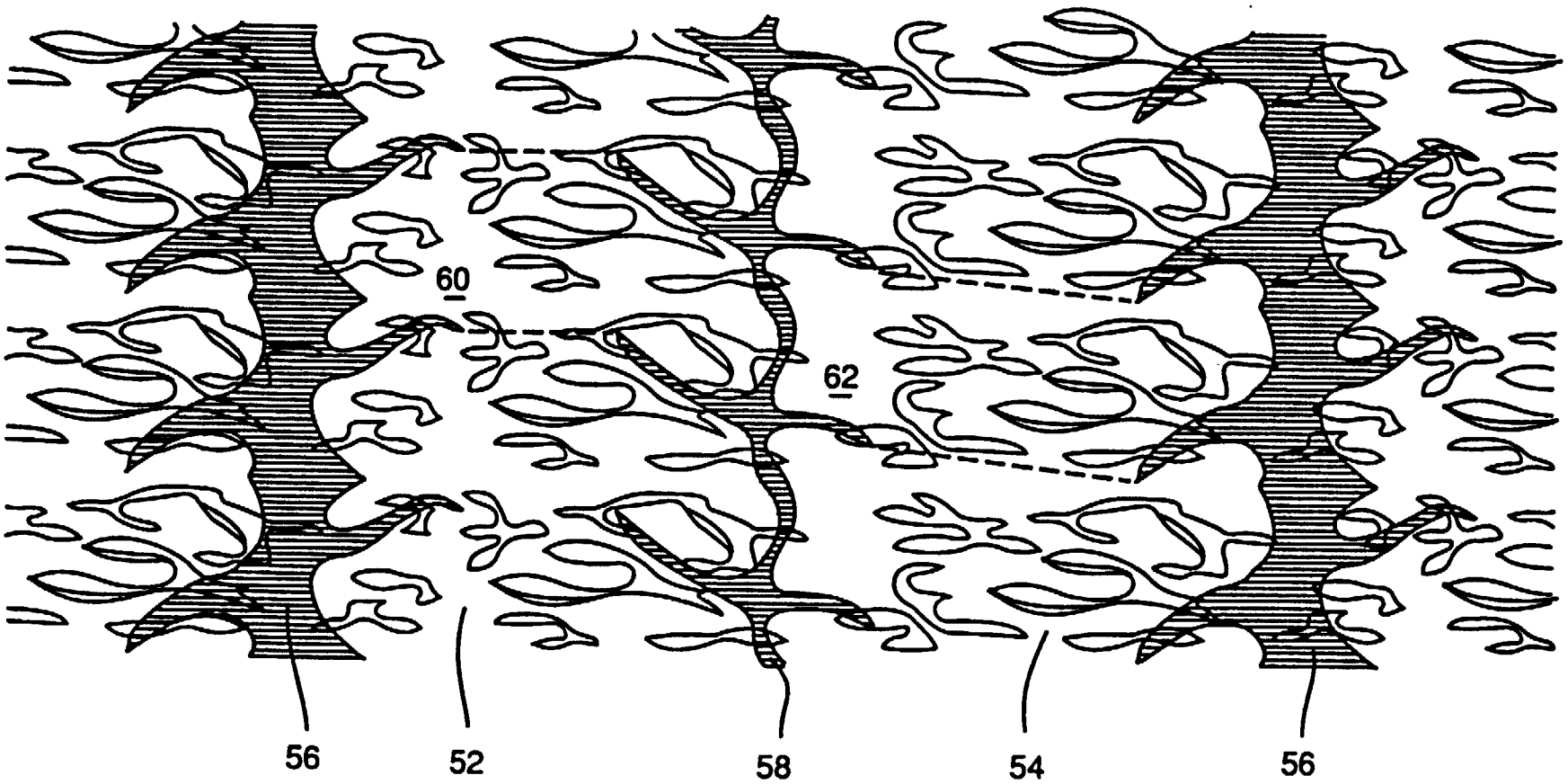
FIG. 4 shows the camouflage system of FIG. 3 having the spaces between the background patterns darkened for clarity.
Figure 5:
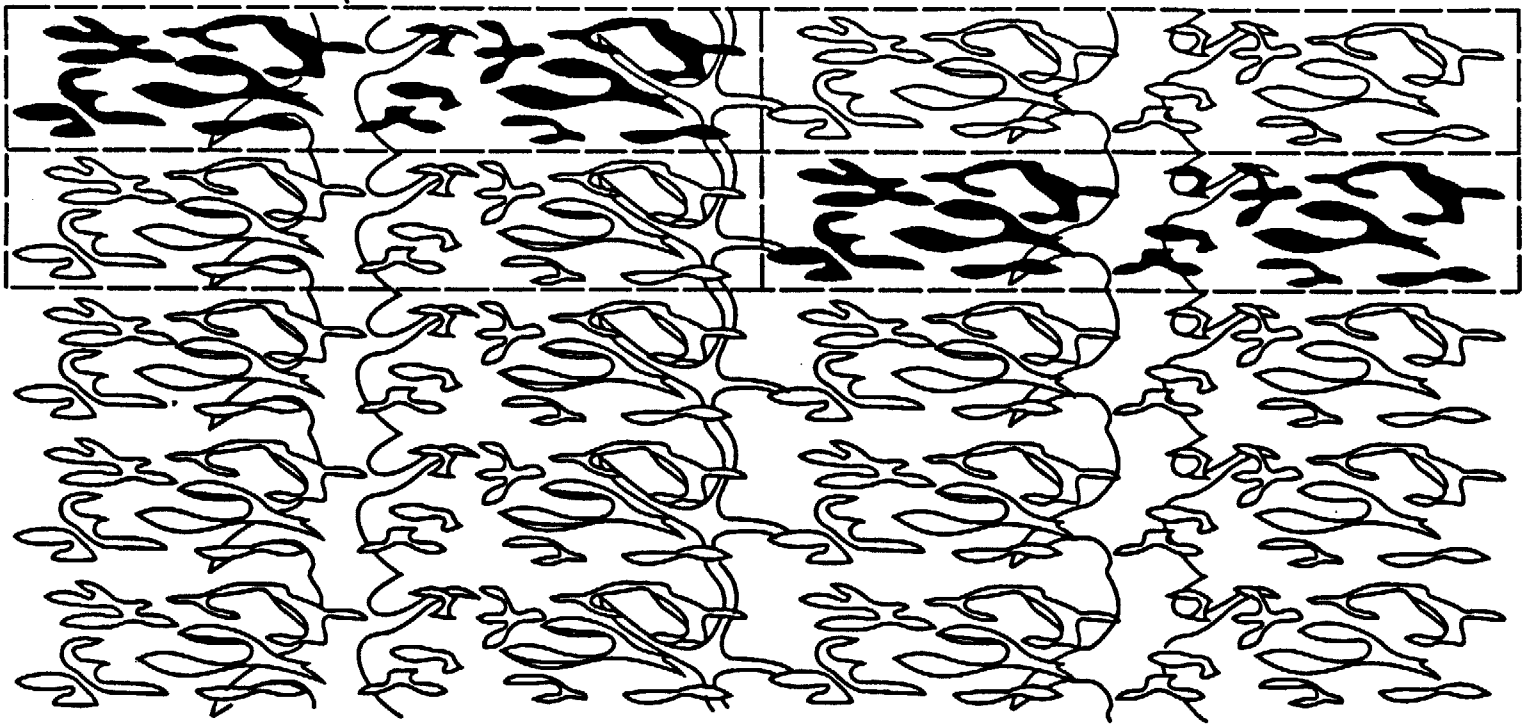
FIG. 5 shows the camouflage system of FIG. 3 having the foreground patterns darkened for clarity.

A specific example of a camouflage system employing the embodiments of this invention is shown in FIG. 3. This specific embodiment has been found to be useful to apply to hunting bows. In FIG. 3, two major background patterns 52 and 54, are separated by two major groups of spaces 56 and 58. Referring now to FIG. 4, the spaces 56 and 58, have been darkened to make them clearly visible. It should be noted that although the vertical background patterns 52 and 54, may be considered a single pattern, they also may be considered as composed individual patterns 60 and 62 (FIG. 4) which have a repetitive dimension equal to the repetitive dimension of the spaces as will be explained below. The background patterns 52 and 54 and the spaces 56 and 58 are overlaid by a foreground pattern 64 shown in FIG.

5. It should be noted that in this specific example, that the vertical repetitive dimension of the foreground pattern is equal to the repetitive vertical sequence of the background pattern and of the spaces which is approximately 2". This is not an absolute requirement of the system of the present invention but rather one specific embodiment.

Figure 6:
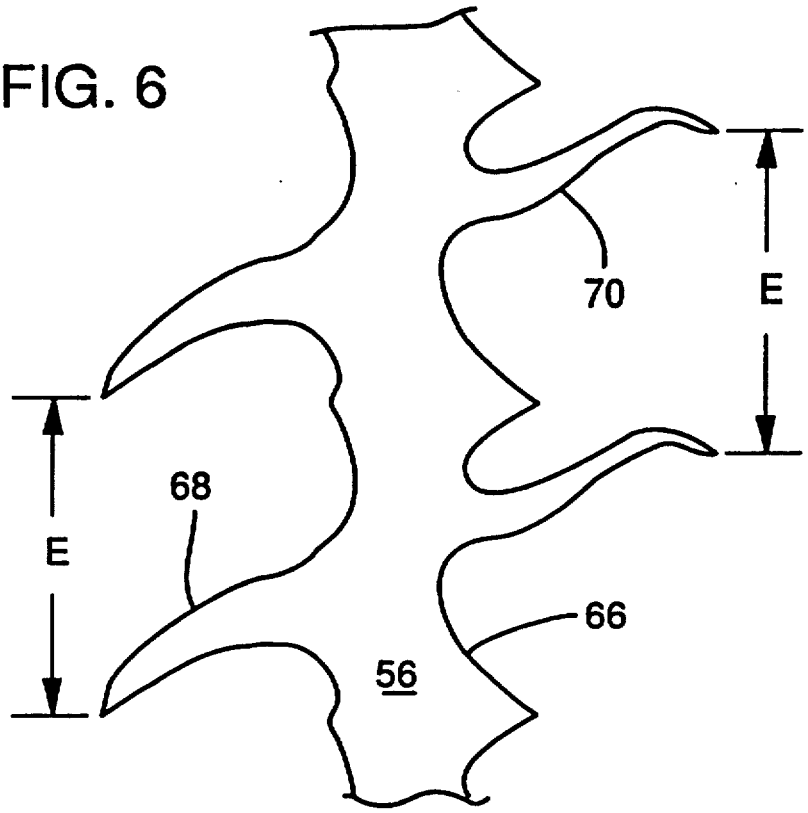
FIG. 6 is an enlarged fragmentary view of one of the wide repetitious spaces between the background patterns of the camouflage system of FIG. 3.

Referring now to FIG. 6, space 56 between the background pattern, is shown in detail. The dimension E, which is approximately 2", is the repetitive dimension of this pattern. The average width of the trunk portion 66 of the background space 56 is approximately 1". The average width of arm 68 is approximately ½", while the average width of arm 70 is approximately ¼". It would be noted that none of the boundaries of the space 56 lies in a horizontal or a vertical plane.

Figure 7:
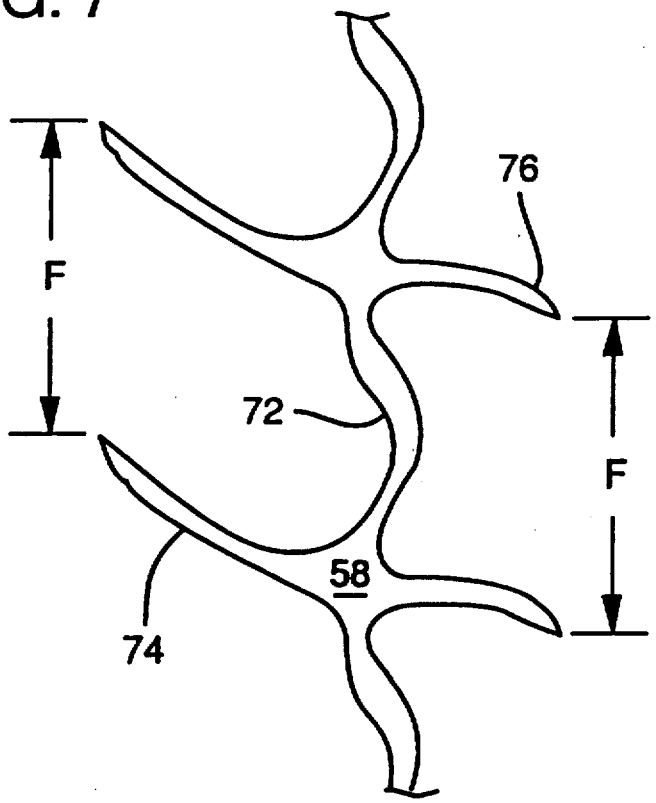
FIG. 7 is an enlarged fragmentary view of one of the narrow repetitious spaces between the background patterns of the camouflage system of FIG. 3.

Referring now to FIG. 7, a smaller background space 58 is disclosed. Again, the repetitive dimension of space F is approximately 2". The trunk of this space 72 is approximately ¼" wide. Similarly, the arm 74 has a varying width, having an average width of approximately ¼". Arm 76 has an average width of approximately ⅛". In a preferred embodiment of this particular camouflage system, the background patterns 52 and 54 have a reflectance level of approximately 4 on the neutral value scale of FIG. 2. The spaces have an average reflectance level of level 8 of FIG. 2.

Figure 8:
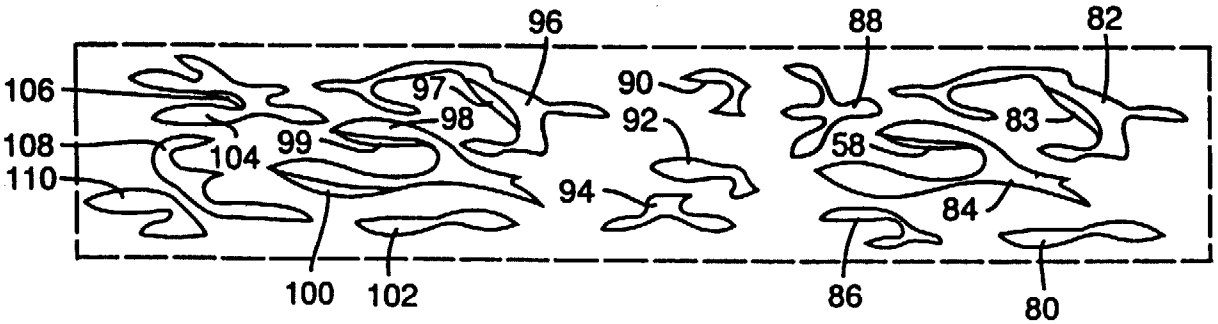
FIG. 8 is an enlarged fragmentary view of one of the repetitious foreground pattern of the FIG. 3 embodiment of the camouflage system of the present invention.

Referring now to FIG. 8, a foreground pattern 64 has a plurality of shapes 80–110 having irregular borders. Each of these shapes is smaller than the smallest background pattern. Each of these foreground shapes within the foreground pattern has an average reflectance level greater than the reflectance level of the background pattern. Not all of the particular shapes in the foreground pattern need have the same reflectance level. Shading is also available to further distinguish these shapes. For example, shape 82 may have a reflectance level of 3, while shading 83 within this shape, may have a reflectance level of 1. The foreground pattern breaks up individual boundaries between the background pattern and the space of the background patterns. The reflectance level of the shapes of the foreground pattern 64 may be chosen such that the overall reflectance level of the total camouflage system will be equal to the reflectance level of the background against which the camouflage system is to be used.

Referring back now to FIG. 3, it can be seen how the space 58 will tend to merge with the background pattern 52 and 54 at intermediate distances such as 75 yards; but even at greater distances, in the neighborhood of 150 yards, the space 56 still distinguishes the groups of background patterns composed of background pattern 52 and 54 such that they do not totally blend together. The embodiment of the invention, as shown in FIG. 3, has been copyrighted and has been found to be especially adaptable for placing on bows and arrows.

Although a general and a specific embodiment of the invention has been heretofore described, many modifications and variations, both in its structure and operation, equivalent in their characteristics, may be applied for by a person skilled in the art without departing from the spirit of the present invention. It is understood that all the modifications and variations are encompassed in its scope as defined by the appended claims.

In summary, as shown in the drawings, the spaces between background patterns are of different widths to differentially visually group background patterns at varying distances to provide increasingly larger groupings of patterns at greater distances. In preferred embodiments, with reference to FIG. 3, a first space 58 separates patterns 52, 54. A second space 56 of a different and greater width separates patterns 52, 54 from an adjacent pattern. The narrower width of space 58 allows patterns 52, 54 to visually merge with one another at a closer distance than they merge with an adjacent pattern.

In the preferred embodiment of FIG. 3 more of the low reflectance foreground pattern is applied over the background 52, 54 than over high reflectance spaces 56, 58.

Yet a higher degree of pattern organization is illustrated in FIG. 1 wherein background patterns 20, 22, 24, 26 are grouped on both sides of a first space 46 to form a first pattern array element. That array is then internally spaced on both sides of a second space 50 which is wider than space 46 and differentially visually groups the background patterns at varying distances. A second pattern array element, that includes patterns 28, 30, 32, 34, is positioned next to the first array 20, 22, 24, 26 and separated by a space 44 that is wider than spaces 46 or 50. The first and second arrays will visually merge at a greater distance than any of their sub-units merge.

As shown in the drawings the spaces are elongated. In the embodiment of FIG. 3 the spaces 56, 58 have longitudinal axes that are parallel. In the embodiment of FIG. 1, spaces 46, 50 have perpendicular axes, whereas the axis of space 44 is parallel to the axis of space 46.

I claim:

1. A camouflage material for visually concealing people and objects comprising:

a flexible base sheet;

a plurality of repetitious background patterns having a first reflectance level applied to a portion of said base sheet, each of said background patterns having an irregularly shaped border without straight horizontal or straight vertical lines defining any portion of said border;

a plurality of spaces between said background patterns, said spaces having a second reflectance level, which is greater than said first reflectance level, said spaces repeating in sequence with the repetition of said background patterns, each of said spaces having an average width that is different from the average width of the other spaces and that differentially visually groups said background patterns into increasingly larger groupings of background patterns at greater distances from said patterns; and a plurality of repetitious foreground patterns applied to said base sheet over said background patterns and said spaces with more of said foreground pattern applied over said background than over said spaces, each of said foreground patterns comprising a plurality of shapes, each of said shapes having an irregular non-linear border and each of said shapes being smaller than any of said background patterns, said foreground patterns having a reflectance level less than the first reflectance level.

2. A camouflaged object having a surface, a plurality of repetitious background patterns applied to said surface;

a first space on said surface separating first and second background patterns and a second space intersecting said first space and separating a plurality of background spaces;

a plurality of repetitious foreground patterns overlaying said background patterns and said spaces applied to said surface;

said background patterns having nonlinear irregular shaped borders and being comprised of a first color carrier means wherein said first color carrier means has a first reflectance level and said first color carrier means is adapted to be placed on people or objects;

said first and second spaces located between said background patterns having different average widths that differentially visually group said first, second and third background patterns together at varying distances from said sheet into increasingly larger groupings of background patterns at greater distances from said patterns, said spaces being comprised of a second color carrier means wherein said second color carrier means has a second reflectance level, said second reflectance level being greater than the reflectance level of said first reflectance level and said second color carrier means being adapted to be placed on people or objects; and said foreground patterns comprised of a plurality of shapes, each of said shapes having an irregular nonlinear border, and each of said shapes being smaller than any of said background patterns, and with more of said foreground pattern applied over said background patterns than over said spaces each of said shapes comprised of additional color carrier means, each of said additional color carrier means having a reflectance level less than the first reflectance level and said additional color carrier means adapted to be placed on people or objects.

3. A camouflage object as recited in claim 2 wherein the first color carrier means, the second color carrier means and the additional color carrier means are cosmetics or paint.

* * * * *

UNITED STATES PATENT AND TRADEMARK OFFICE

CERTIFICATE OF CORRECTION

PATENT NO. : 5,043,202

DATED : August 27, 1991

INVENTOR(S) : Harry W. Knickerbocker

It is certified that error appears in the above-indentified patent and that said Letters Patent is hereby corrected as shown below:

On the title page, item [73]: "System" should read --Systems--.

Column 1, line 41, "but:" should read --but--.

Column 4, line 44
"used:" should read --used--.

Signed and Sealed this

Eleventh Day of April, 1995

Bruce Lehman

*Attest:*

BRUCE LEHMAN

*Attesting Officer*

*Commissioner of Patents and Trademarks*